United States Patent [19]

Mittelkötter

[11] 4,344,357

[45] Aug. 17, 1982

[54] APPARATUS FOR EXTENDING VENTILATING CONDUITS

[75] Inventor: Alfred Mittelkötter, Witten, Fed. Rep. of Germany

[73] Assignees: Ruhrkohle AG; Maschinenfabrik Korfmann GmbH, both of Fed. Rep. of Germany

[21] Appl. No.: 183,032

[22] Filed: Sep. 2, 1980

[30] Foreign Application Priority Data

May 27, 1980 [DE] Fed. Rep. of Germany ..... 3020121

[51] Int. Cl.[3] ..... E21F 1/08

[52] U.S. Cl. ..... 98/50; 98/40 C; 98/115 VM; 98/DIG. 7; 138/119; 138/120; 285/302

[58] Field of Search ..... 17/41, 42; 29/429, 431; 98/40 C, 50, 115 VM, DIG. 7; 138/119, 120; 285/177, 260, 302; 299/12

[56] References Cited

U.S. PATENT DOCUMENTS

| | | | |
|---|---|---|---|
| Re. 30,390 | 9/1980 | Kupcikevicius et al. | 17/41 X |
| 2,410,786 | 11/1946 | Mallory | 285/260 |
| 2,871,508 | 2/1959 | Hill | 17/41 |
| 3,010,144 | 11/1961 | Kochjohann | 17/41 X |
| 3,705,736 | 12/1972 | Dawson | 285/260 |
| 4,104,774 | 8/1978 | Overmyer et al. | 17/41 X |
| 4,202,075 | 5/1980 | Michel et al. | 17/41 |

FOREIGN PATENT DOCUMENTS

| | | | |
|---|---|---|---|
| 2433034 | 1/1976 | Fed. Rep. of Germany | 98/50 |

*Primary Examiner*—Albert J. Makay
*Assistant Examiner*—Harold Joyce
*Attorney, Agent, or Firm*—Robert E. Burns; Emmanuel J. Lobato; Bruce L. Adams

[57] ABSTRACT

Apparatus for continuously extending ventilating conduits in tunnelling or mining environments includes a tubular ventilating pipe store to one end of which a nozzle is releasably connected and to the other end of which a nozzle is releasably connected and to the other end of which a funnel guide is releasably connected. The ventilating pipe store contains a folded-up flexible ventilating pipe adapted to be connected to the end of a ventilating conduit to be extended. A frame is provided and support means adapted to support the nozzle, the ventilating pipe store and the funnel guide on the frame. In use, the apparatus is continuously advanced and the ventilating pipe is gradually pulled out of the store and unfolded by being passed over the funnel guide. When the store is empty it is moved away laterally and replaced with a new one, and the end of the ventilating pipe within it is connected to the free end of the ventilating conduit without it being necessary to halt the advance of the apparatus. The ventilating pipe store is supported by the frame except during those periods when it is being exchanged, and the funnel guide is supported by the frame only during the periods when the ventilating pipe store is being exchanged.

29 Claims, 18 Drawing Figures

APPARATUS FOR EXTENDING VENTILATING CONDUITS

BACKGROUND OF THE INVENTION

The invention relates to an apparatus for guiding and extending ventilating conduits in mining and tunnelling conditions.

Particularly by reason of the use of self-propelled mining and tunnelling machines, the rates of advance when digging tunnels and galleries have risen to such an extent that extending the ventilating conduit to provide the necessary ventilation at the mine face in pace with the mining or tunnelling machine presents considerable difficulties.

When mining or tunnelling it is often impossible to maintain the outlet end of the ventilating conduit directly at the face. Particular difficulties also arise when there is a connection between the ventilating conduit and the self-propelled mining machine when the latter is moved backwards. In order to ensure the maintenance of the constant distance between the ventilating outlet opening and the face prescribed by the mining authorities, nestable ventilating pipes have been used for some time as a ventilating pipe store. Such ventilating pipe stores are complicated to build, are expensive to buy and awkward to use. Furthermore they can only store relatively short lengths of the ventilating conduit.

In contrast to this it is the object of the invention to provide an apparatus for guiding and extending ventilating conduits which avoids the disadvantages mentioned above and which represents a simple, safe and economical solution to the problems arising in the extending and guiding of ventilating conduits.

SUMMARY OF THE INVENTION

According to the present invention there is provided an apparatus for guiding and extending installed ventilating conduits, said apparatus including a ventilating pipe or conduit store, said ventilating pipe store having an upstream end and a downstream end, a funnel guide releasably connectable to said upstream end of said ventilating pipe store and an outlet nozzle releasably connectable to said downstream end of said ventilating pipe store, and a flexible ventilating pipe withdrawably accommodated in a folded condition on said ventilating pipe store, said ventilating pipe having an upstream end adapted to be connected to a ventilating conduit. The apparatus further includes a main frame adapted to carry said ventilating pipe store and said funnel guide, whereby, in use, said apparatus is advanced and said flexible ventilating pipe is progressively withdrawn from said ventilating pipe store to extend along an axial line of said apparatus and guided over said funnel guide, said store being exchanged when empty for a full store, said main frame carrying said ventilating pipe store except during those periods when said ventilating pipe store is being exchanged and carrying said funnel guide only during said periods.

When using such an apparatus there is connected to one end of a ventilating conduit a further ventilating pipe section which is received on a store. At the forward end of the store there is mounted a conventional outlet nozzle for a ventilating conduit, and this arrangement of the ventilating pipe store and outlet nozzle is drawn along behind during the advancing tunnelling so that gradually the folded ventilating pipe section is unfolded into an extended tube. To ensure a complete unfolding and the transition of the cross-sectional area of the open ventilating pipe to the diameter of the store, a funnel which is securable to the latter is automatically pulled through the ventilating conduit or the ventilating pipe is drawn over the funnel.

With such an apparatus, extensions of the ventilating conduit of considerable size can be achieved by changing an empty store for a store filled with a folded ventilating pipe. The effort and expense which was previously necessary for extending ventilating conduits in open-cast and underground conditions is considerably reduced. However, the store can weigh 6000 N, or even more, depending on the diameter of the ventilating pipe and the stored length, and changing such a store can be impossible or at best require considerable physical exertion on the part of the personnel involved.

For this reason the invention provides that the nozzle is mounted on a single or multi-part frame arranged in the region of the ventilating pipe store and the funnel, which frame carries the ventilating pipe store except during the periods when it is exchanged and to which the funnel is securable during these periods. The weight of the ventilating store can therefore be carried by the frame.

The unit constituted by the nozzle, the ventilating pipe store and the funnel is, in accordance with the invention, supported both at the nozzle and also in the region of the ventilating pipe store when in the normal operating state. Merely the funnel which is drawn through the ventilating pipe is unsupported, it is however carried by the associated end of the ventilating pipe store with adequate security. Then when exchanging an empty ventilating pipe store for a full one, the connection with the nozzle and with the funnel must be released with the result that the individual components which previously constituted a unit must each be supported separately. This function is performed by the frame.

The temporary support of the funnel, which is only necessary during the periods when the ventilating pipe store is exchanged, can either be effected by propping up the funnel together with the ventilating pipe surrounding it or by forming a direct mechanical connection between the frame and the funnel when the ventilating pipe to be extended has been pulled out of the ventilating pipe store, but not so far that the funnel is completely exposed. The components of such an apparatus are described below in detail.

In accordance with the local circumstances, the frame can be arranged on the upper side of the unit formed by the nozzle, the ventilating pipe store and the funnel so that all parts of this unit are permanently or temporarily suspended from the frame. The frame can, for its part, be suspended from a working platform or tracks secured to the ceiling, but it can also be mounted as a carrying arm on a propulsion machine. Alternatively the frame is arranged on the underside of the above mentioned unit so that the components of this unit rest, permanently or temporarily, on the frame. It is then particularly advantageous to provide, in the vicinity of the ventilating pipe store, a sliding or tipping device with which the ventilating pipe store may be brought laterally out of the vicinity of the ventilating pipe when an exchange is to be carried out. In this connection it is particularly convenient so to lay the freshly inserted full ventilating pipe store on the sliding or tipping device that after it has been pushed or pivoted into the region of the ventilating pipe it automatically takes up at least its radial position with respect to the nozzle secured to the frame. This occurs most simply with correspondingly profiled projections on the sliding or tipping device on which the ventilating pipe store may be rested in an almost form-sealing manner and thus precisely.

Depending on the connection between the nozzle and the ventilating pipe store on the one hand, and the ventilating pipe store and the funnel on the other hand, it is advantageous to provide a relative movement between the respective parts, in particular when the connection is in the form of a short plug connection with overlapping regions. Thus the nozzle can be firmly secured and the two other parts be movable away from one another and from the nozzle. In addition the nozzle and the funnel can both also be constructed to be movable away from the ventilating pipe store. Such facilities for movement may be dispensed with when the connections in question must be aligned not with the help of a plug connection but simply abut one another or are arranged spaced apart, whereby in the latter case the sealing is achieved by a collar, e.g. in two sections, engaging over both parts which can be susequently brought into the required position with the aid of rapid fasteners.

An extremely important further feature of the invention resides in that the funnel may be braced against the nozzle through the ventilating pipe store with the aid of connecting elements. Two rods serve as connecting elements which are releasably securable to a portal-like further frame mounted on the said frame, and the rods extend through the ventilating pipe store and are also releasably securable to the funnel. The bracing is brought about with the aid of motorized tensioning elements which are secured to the further frame and which can be brought into engagement with both rods.

With the aid of this arrangement the unit formed by the nozzle, the ventilating pipe store and the funnel is held together in the axial direction exclusively by the tensioning elements mounted on the portal-like further frame. This has the advantage that at the junction between the ventilating pipe store and the funnel, no individual motorized tensioning elements are necessary. This is important in that the funnel is not accessible during running operation due to the ventilating pipe passing over it with the consequence that all the supply lines for the various motorized tensioning elements would have to be interrupted for running operation and restored again for an exchange of the ventilating pipe store. Particularly with hydraulically or pneumatically actuated tensioning elements the supply lines for connecting elements have shown themselves to be vulnerable in mining and tunnelling conditions.

In accordance with a preferred feature of the invention the store has an annular space to accommodate the ventilating pipe which is defined by an outer and an inner cylinder and which is closed towards the nozzle and open towards the funnel.

In this manner the ventilating pipe situated in the store is completely protected from external influences during its entire transport. The ventilating pipe store can therefore be put down anywhere without endangering the ventilating pipe and there is no danger of the ventilating pipe being either dirtied or damaged. Furthermore this construction of the ventilating pipestore offers the advantage that the ventilating pipe can be stuffed into the annular space in a virtually disordered manner and, nevertheless experience shows, that an undisturbed continuous automatic withdrawal occurs. Handling the ventilating pipe store, be it full or empty, is facilitated by this cassette-like construction because the ventilating pipe store can be provided on its outer surface with eyes or other means which enable it to be suspended from crane hooks or the like.

BRIEF DESCRIPTION OF THE DRAWINGS

An embodiment of the invention will now be described in more detail with reference to the drawings in which;

FIGS. 7 and 7*a* is a side view similar to FIG. 1 after bringing up a full ventilating pipe store before initiation of the running operation;

DESCRIPTION OF THE PREFERRED EMBODIMENTS

Figure 1:
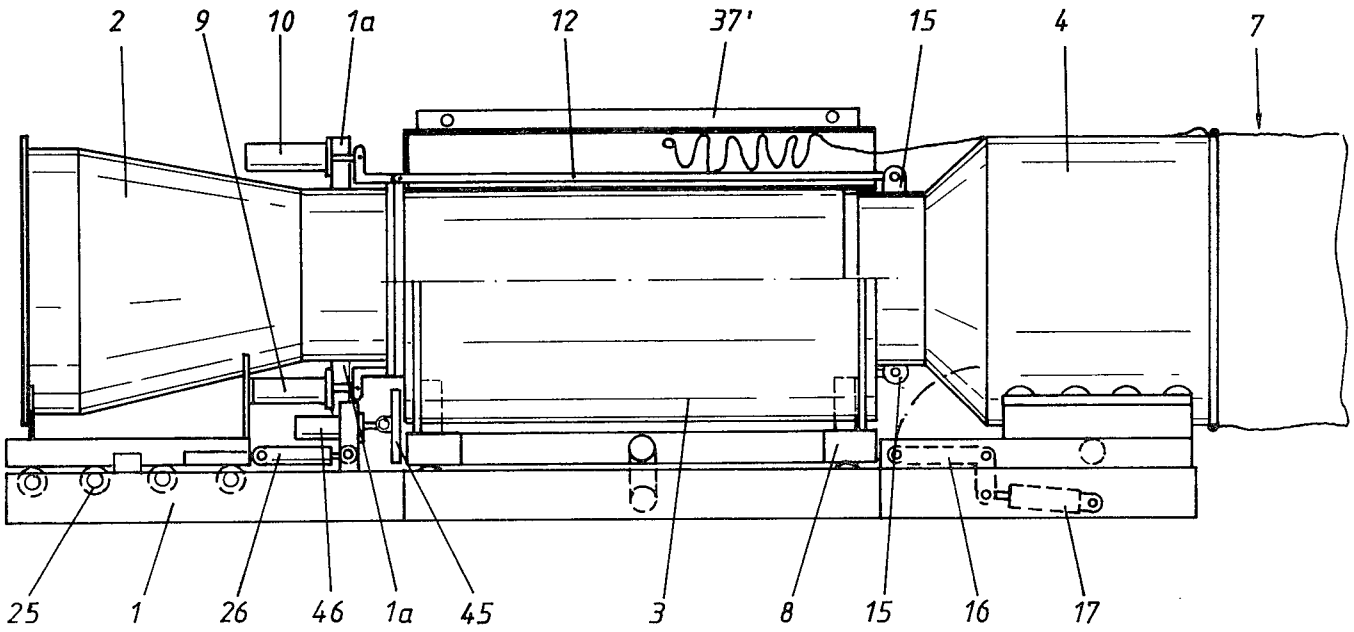
FIG. 1 is a side view of an apparatus according to the invention in running operation.
Figure 8:
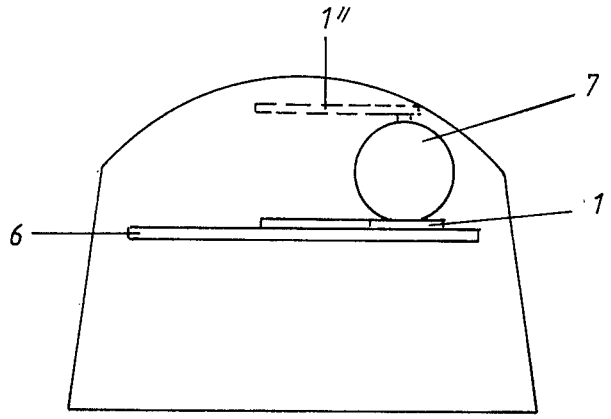
FIG. 8 is an extremely schematic cross-sectional view through a mine gallery which is ventilated with the aid of a ventilating pipe in accordance with the invention.

The apparatus in accordance with the invention is shown in FIG. 1 in running operation. On the front end of a frame 1 there is a nozzle 2 and behind it a ventilating pipe store 3 connected to which is a funnel or guide member 4. The unit comprising these elements is secured for instance, on a working platform 6 (FIG. 8) which during the advancing operation is advanced forward at a constant distance from the tunnel face. The embodiment illustrated in the figures has the frame 1 below the ventilating pipe as shown in FIG. 8. However the frame can also be mounted above the ventilating pipe thus forming an overhead frame 1″ from which the individual parts, that is to say the nozzle 2, the ventilating pipe store 3 and the funnel 4, are suspended permanently or temporarily. The choice between the one or the other type of frame must be made in accordance with the local circumstances, e.g. in accordance with the amount of space available.

In running operation, the funnel 4 and the nozzle 2 are indirectly connected to two rods 12 and 14. They are clamped together with the ventilating pipe store to form a unit so that the nozzle 2 is temporarily fixedly secured to the frame 1 and the ventilating pipe store rests in a form-locking manner on the frame, 1. With respect to the frame the funnel 4 is not supported during running operation but is suspended as a centilever from the associated end of the ventilating pipe store 3 thus ensuring that the ventilating pipe can pass unhindered between the funnel and the frame. When the ventilating pipe loaded into the ventilating pipe store 3 is completely unfolded and has left the ventilating pipe store but still surrounds the funnel 4, a full ventilating pipe store is put in position so that the propulsion machine does not have to be stopped.

Figure 10:
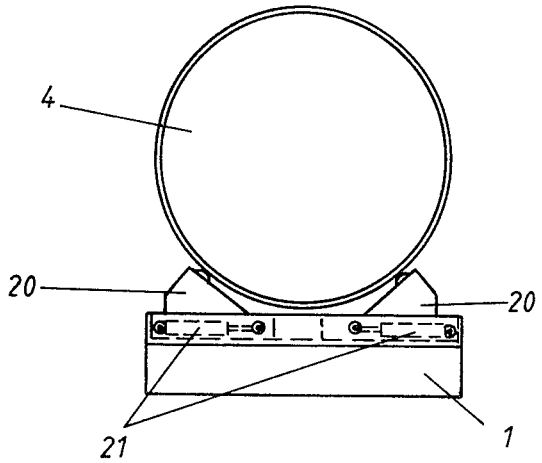
FIG. 10 is a simplified view of the apparatus according to the invention from the funnel side.

The placing in position of a full ventilating pipe store is shown in FIGS. 2 to 7. The first step is to move the rods 12, 14 to the right by means of two pneumatically activated piston/cylinder units 9,10 which are mounted on a portal-like frame 1*a* secured to the frame 1 so that the funnel 4 comes out of engagement with the ventilating pipe store 3. Next the connection between the lower rod 14 and the lower eye 15 on the funnel 4 is detached. In order to remove the pressure exerted on this connection by virtue of the overhang of the funnel, supports 20 (FIG. 10) can be moved under the funnel 4 with the aid of pneumatically actuated piston/cylinder units 21 so that the ventilating pipe 7, loosely surrounding the funnel, does not jam.

As soon as the pressure on the connection between the rod 14 and the lower eye 15 is reduced, the connection is released, for instance by removing a bolt, and the corresponding cylinder 9 is returned to its starting position. To fix the funnel, a pivot arm 16 is moved up by means of a further piston/cylinder unit 17, which arm lies outside the ventilating pipe 7 in its rest position and whose free end lies in the vicinity of the lower eye 15 on the funnel 4 when in its actuated position. The connection between this pivot arm 16 and the funnel 4 is again achieved, for example, by the insertion of a bolt. Finally the upper rod 12 is also freed from the upper eye 15 and the cylinder 10 is returned to its left hand starting position.

Figure 3:
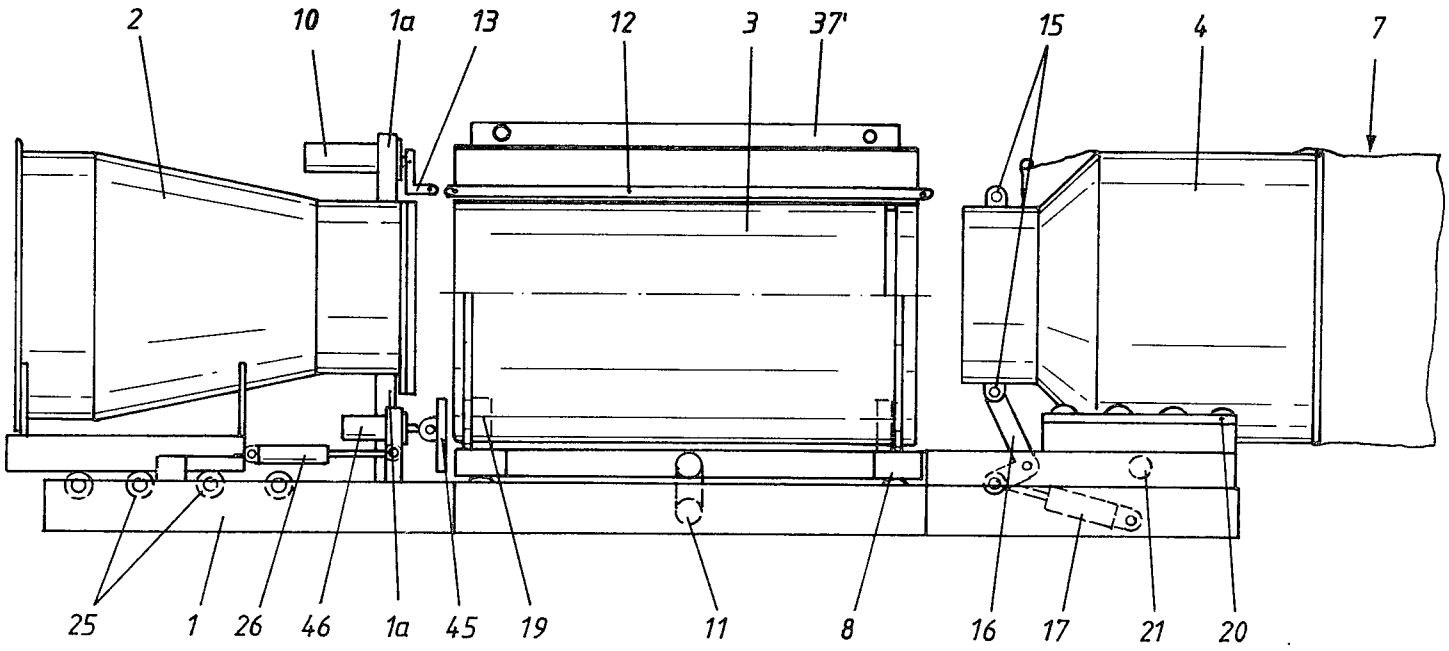

Next, the nozzle 2 is separated from the empty ventilating pipe store 3 (FIG. 3). For this purpose a piston/-cylinder unit 26 arranged between the support of the nozzle 2 and the frame, preferably centrally on the latter, is extended, which moves the support which is mounted on a roller track 25, and thus the nozzle itself away from the ventilating pipe store 3 by a predetermined amount limited by an abutment. Either before releasing the nozzle 2 from the ventilating pipe store 3 or thereafter, the two rods 12 and 14 are detached from the piston rods or from the cranks 13 secured thereto and pushed into their central position within the ventilating pipe store 3. (For reasons of clarity the lower piston/cylinder units 9 and the associated rod 14 are not shown in FIG. 3). Finally a track 45, which will be described below, is released from the ventilating pipe store 3 by means of drives 46.

Figure 4:
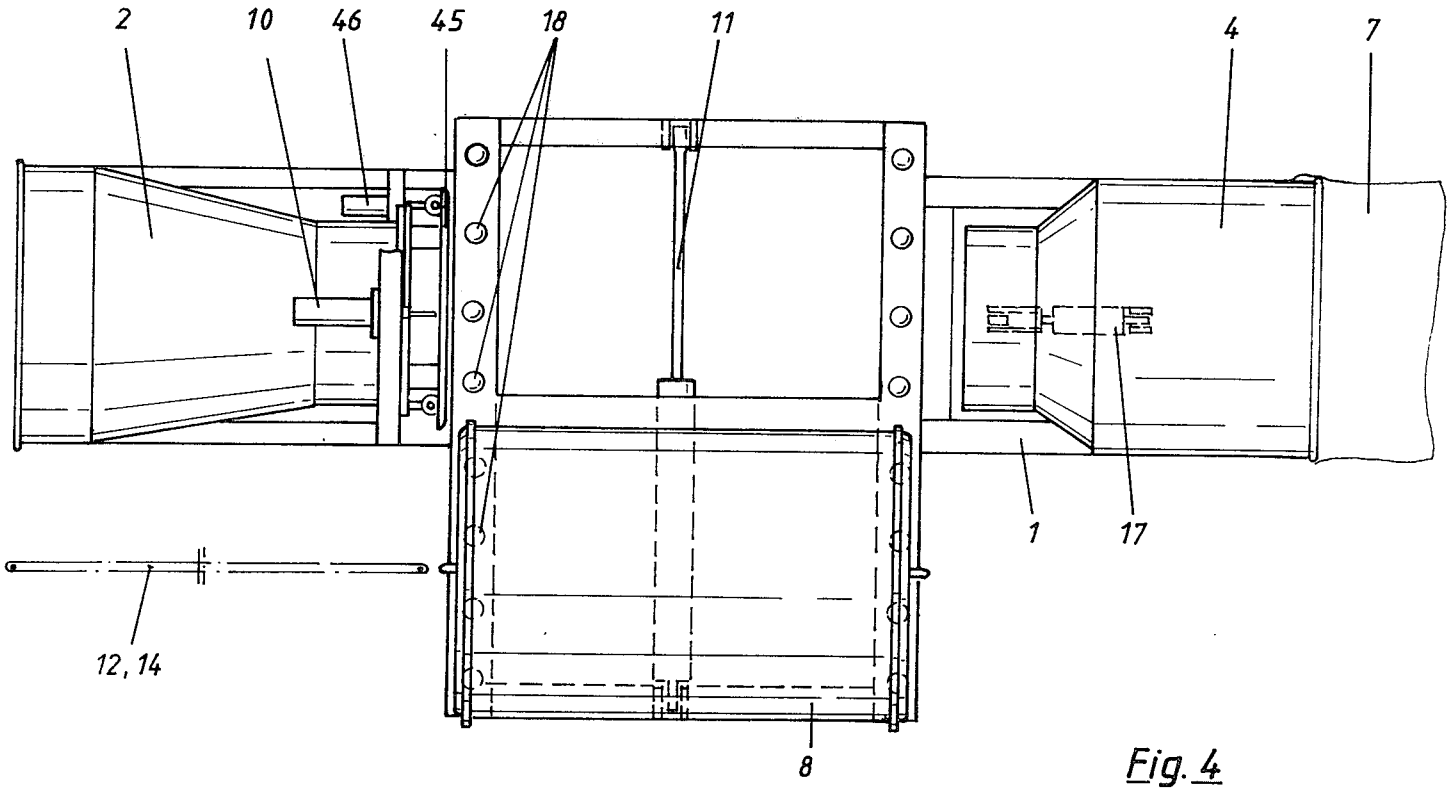
FIG. 4 is a plan view of the apparatus according to the invention with the ventilating pipe store moved laterally out of the vicinity of the ventilating pipe.

FIG. 4 shows that the frame 1 has a lateral extension in the region of the ventilating pipe store 3 to support the ventilating pipe store 3 when it is moved laterally out of the vicinity of the ventilating pipe 7. In this region the frame is provided with a sliding track 1' transverse to the blowing direction of the ventilating pipe comprising ball bearings 18, on which a sliding carriage 8 can slide back and forward.

To effect this movement a further piston/cylinder unit 11 is provided, one end of which is connected to the sliding carriage 8 and the other end of which is secured to the frame 1.

Figure 9:
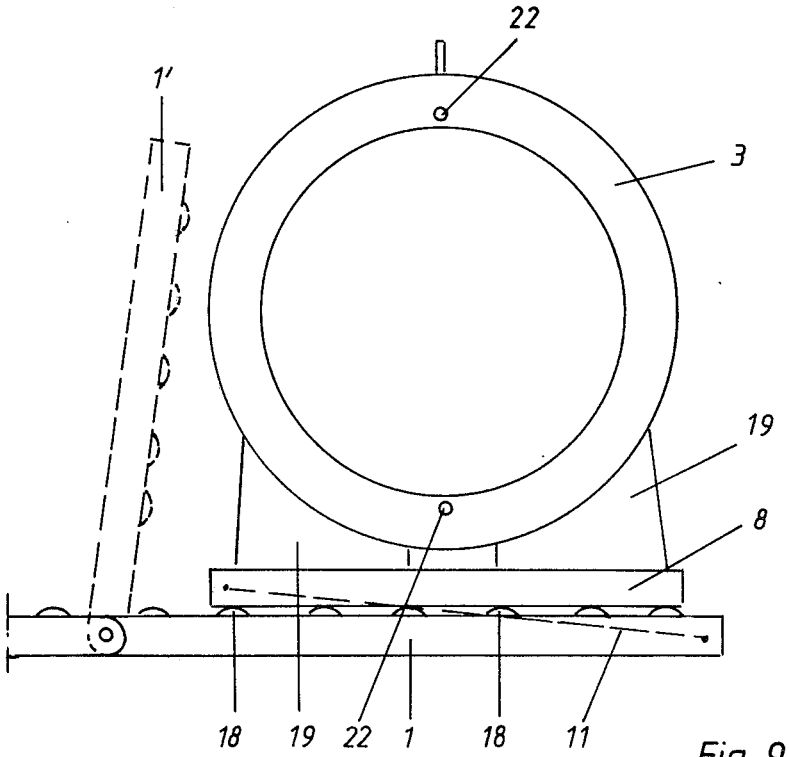
FIG. 9 is a simplified cross-sectional view of an apparatus according to the invention at the height of the ventilating pipe store.

After moving the empty ventilating pipe store 3 laterally, the two rods 12 and 14 can be pulled without hindrance out of the corresponding guides 22 (FIG. 9) in the ventilating pipe store 3. The empty ventilating pipe store can now be replaced by a full one with those means which are commonly available at the mine face. The full ventilating pipe store is positively supported on the sliding carriage 8 with the aid of cross-pieces and held in the removed position which, as regards its height, corresponds to the later operational position with respect to the nozzle and the funnel. Before the piston/cylinder unit 11 returns again to its initial position with the filled ventilating pipe store resting on the sliding carriage 8, the two rods 12 and 14 are pushed into the guides 22.

After moving the sliding carriage back, the laterally over-hanging portion 1' of the frame 1 is folded into an upright position so that in running operation no additional space is required by this frame extension. During the insertion of the ventilating pipe store 3 into the region of the ventilating pipe and also thereafter, the ventilating pipe store 3 is aligned and guided with the help of the track 45, whereby the position of the track is controlable with the aid of two piston/cylinder units 46 acting as drive means which are secured to the frame 1 by means of brackets.

Figure 5:
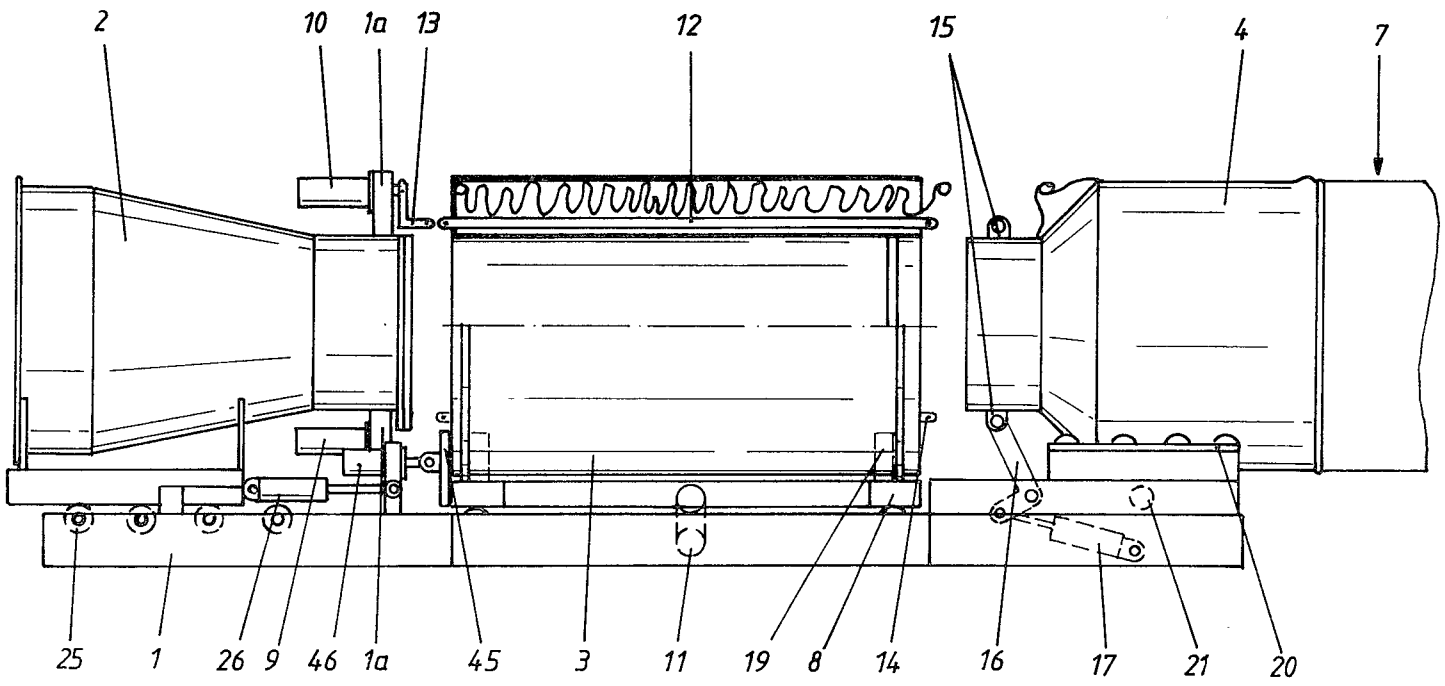
FIGS. 5 and 6 are views similar to FIG. 1 to illustrate further stages of the exchange of a ventilating pipe store.

In FIG. 5 the apparatus in accordance with the invention is shown in the position which results after bringing in the full ventilating pipe store. First the two rods 12 and 14 are secured again to the cranks 13 of the two piston/cylinder units 9 and 10. Next the nozzle 2 is advanced onto the left hand portion of the ventilating pipe store 3 with the aid of the piston/cylinder unit 26, this advancing of the nozzle 2 onto the ventilating pipe store 3 can also occur before the connection of the rods 12 and 14 to the cranks 13. During the engagement of the nozzle, the track 45 together with its drive elements 46 is, if necessary, brought into action in order to align the two parts.

Figure 6:
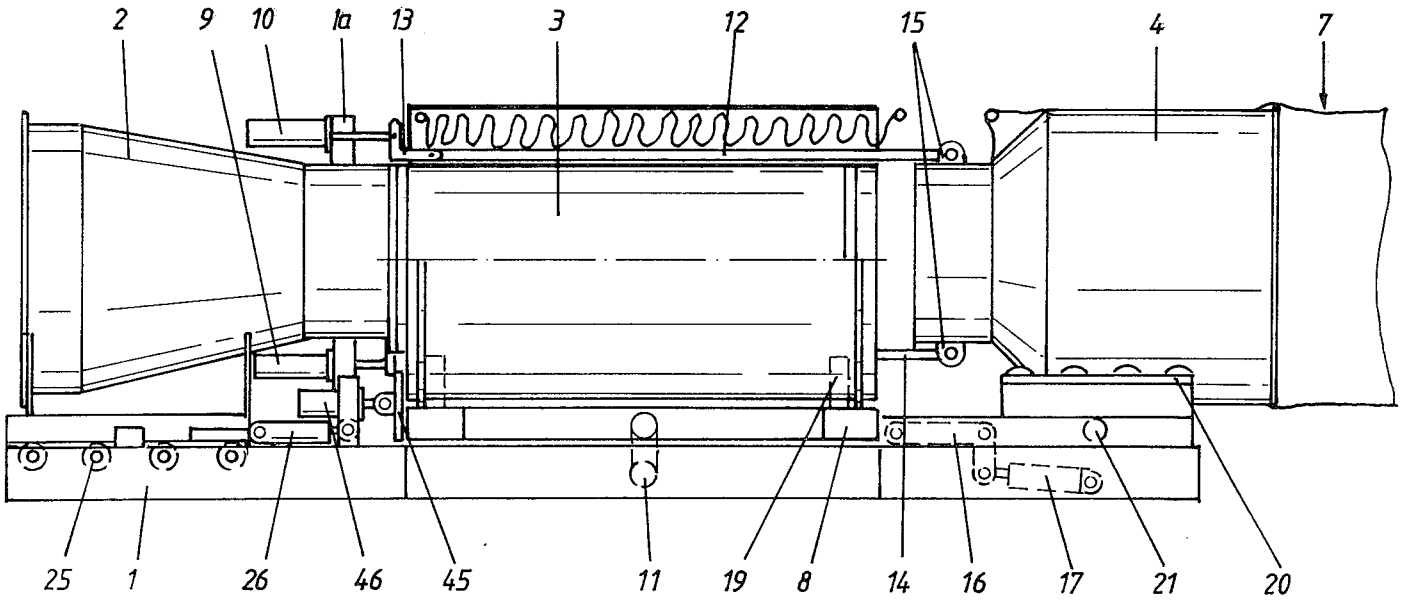
Figure 7:
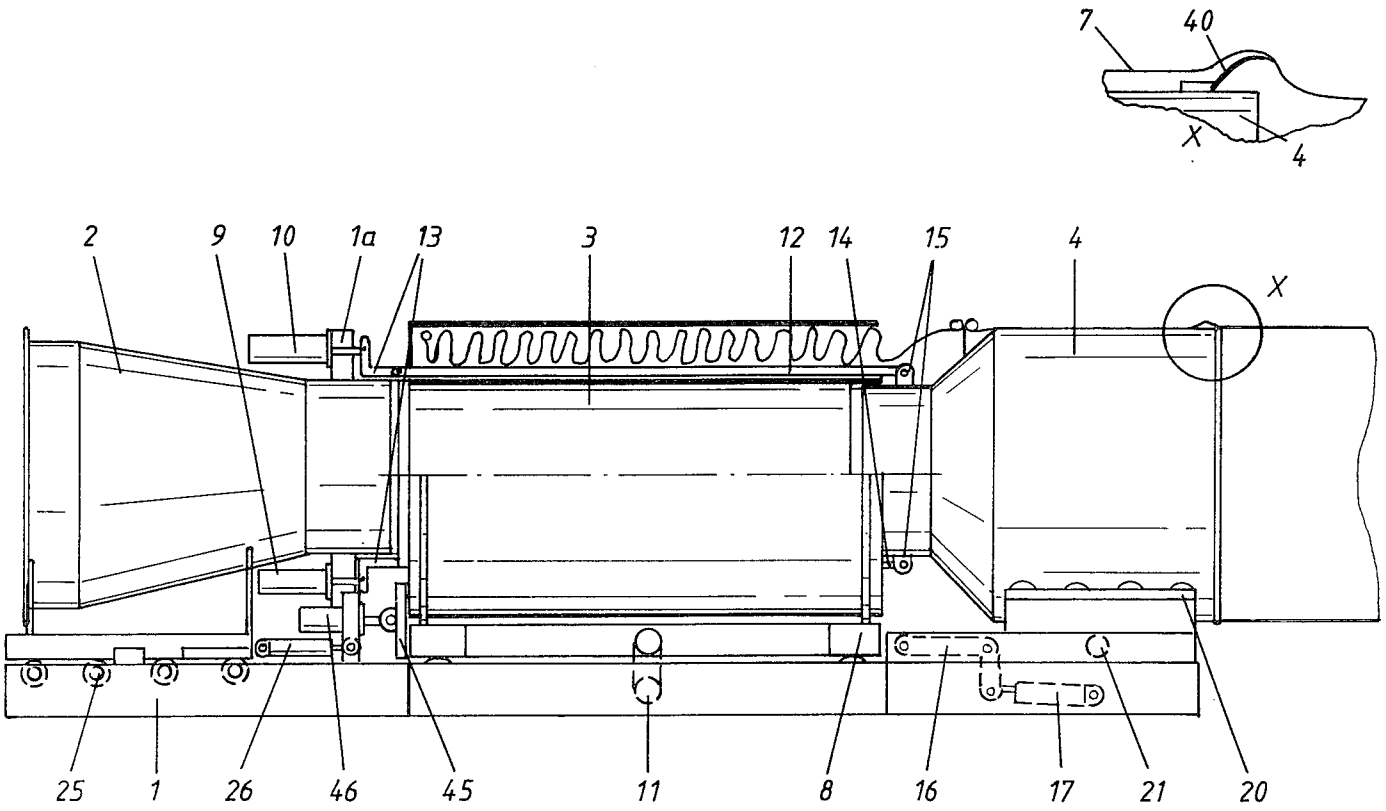

Next the piston/cylinder unit 10 is fully extended, so that the rod 12 reaches its extreme right hand position (FIG. 6). Its outer right hand end lies therefore in the vicinity of the upper eye on the funnel 4 so that this connection can now be simply accomplished. After freeing the pivot arm 16 from the lower eye 15 on the funnel 4, it is pivoted back into its original position by means of the piston/cylinder unit 17 so that the lower eye is free to receive the lower rod 14. If, contrary to expectation, difficulties should arise when connecting the two rods 12 and 14 to the funnel 4, the support 20 with its diversity of possible positions can be brought into action to lift the funnel or to move it laterally. In this connection it is particularly advantageous to arrange the two rods 12 and 13 vertically one above the other. Once the connection between the upper rod 12 and the upper eye 15 has been achieved, then by lowering the support 20 the funnel 4 can be made to hang substantially straight so as to facilitate the subsequent engagement of the lower rod 14 with the lower eye 15. In any case there is adequate opportunity for fine adjustment to achieve the connection of the rods 12 and 14 to the funnel in a relatively short time.

When the two rods 12 and 14 have been secured to the funnel 4, the support 20 is moved to the side so that the funnel 4 is again suspended from the two rods in the manner of a cantilever.

By operation of the two piston/cylinder units 9 and 10, the funnel 4 is pressed against the right hand side of the ventilating pipe store and in turn the left hand side of the latter is pressed against the nozzle 2 thus achieving a final stability of these three components and the final seal at the joints between them. This occurs with the aid of large stroke sealing means, such as rubber lips or rubber sponge which are secured to the surfaces which come together. The centering of the individual parts can be achieved by means of cones or cylindrical overlapping regions.

Figure 11:
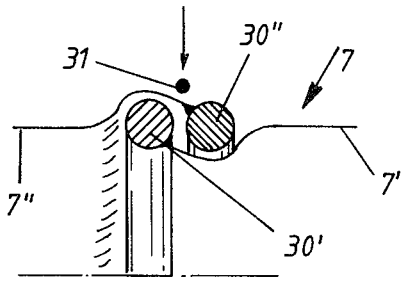
FIG. 11 is a cross-sectional view of the part X indicated in FIG. 7.

As a last step the free end of the ventilating pipe must be connected to the ventilating pipe section inserted in the ventilating pipe store. The position of this joint can be seen from FIG. 7, and this is shown in more detail as the detailed section X and in FIG. 11. Both ends of the ventilating pipes terminate in a bead 30', 30'' which is slightly larger than the external diameter of the ventilating pipe 7. In a preferred connection the one bead 30' is pushed through the other 30'' so that they lie directly adjacent to one another and are covered internally and externally by the ventilating pipe skin. To secure the connection, a wire rope is laid between the two beads 30' and 30'' on the external side of the one ventilating pipe section, which deforms the ventilating pipe skin lying beneath it by a predetermined amount. The deformation is not shown in FIG. 11, however, the arrow above the wire rope 31 points in its direction of tension. The wire rope 31 can be formed as a prefabricated component with a corresponding length and a rapid closure. It is, however, also possible to make a bundle of thinner wires in which each wire is individually secured.

In another type of connection, which is not illustrated in a figure, the two beads abut one another and a, for instance, two part clip is placed around this double ring which stands proud with respect to the remainder of the ventilating pipe skin, which clip engages the two beads in a form-sealing or locking manner. Furthermore it is extremely important that the connection between two ventilating pipe sections be reliable and easily effected and, in addition, that it can be ensured that the funnel can be guided past this connection point without being significantly restrained and without the connection being damaged or even destroyed.

To seal the funnel 4 to the ventilating pipe 7, a sealing lip 40 (FIG. 7) can be mounted in the vicinity of its right hand edge which in the unloaded state points obliquely upwards against the blowing direction in the ventilating pipe and is pressed to a more cylindrical state by the somewhat smaller internal diameter of the ventilating pipe. The pressure arising on the right hand side within the ventilating pipe leads to an automatic rising up of the sealing lip when there are irregularities in the internal diameter of the ventilating pipe 7. Slight leakage losses can facilitate the unfolding of the stored ventilating pipe. Furthermore a flexible tubular ring secured to the exterior of the funnel can also advantageously be used as a seal.

The unfolding of the ventilating pipe from a freshly inserted ventilating pipe store occurs, as experience shows, without problem from the open side of the ventilating pipe store continuing to its closed end. If it should be feared, though experience has shown that such fears are groundless, that shortly before the ventilating pipe store 3 is completely empty the remaining connections and folds might be pulled out of the ventilating pipe store in one piece because in this region there is insufficient tensile force promoting the unfolding at the end of the ventilating pipe, then to prevent such an unintended falling out of the ventilating pipe in its folded or inserted state the end of the ventilating pipe can be fixed to a disc 38, which with the help of one or more closures 39 is held against the left hand wall of the ventilating pipe store until the ventilating pipe 7 has completely unfolded. Then the closure or closures 39 are released from outside and the disc 38 can slide unimpeded on the inner cylinder 36 of the ventilating pipe to its right hand open end where the ventilating pipe can be detached from the disc without difficulty.

Figure 2:
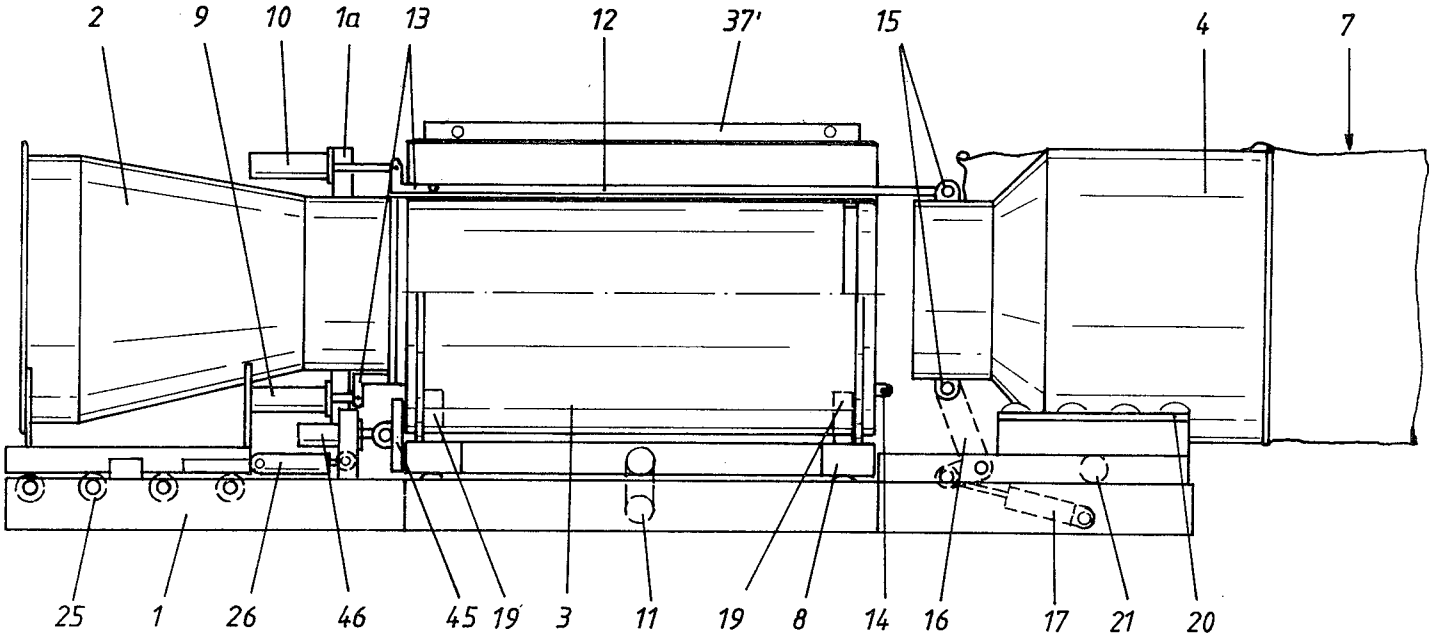
FIGS. 2 and 3 are views similar to FIG. 1 to illustrate different stages in the exchange of a ventilating pipe store.
Figure 12:
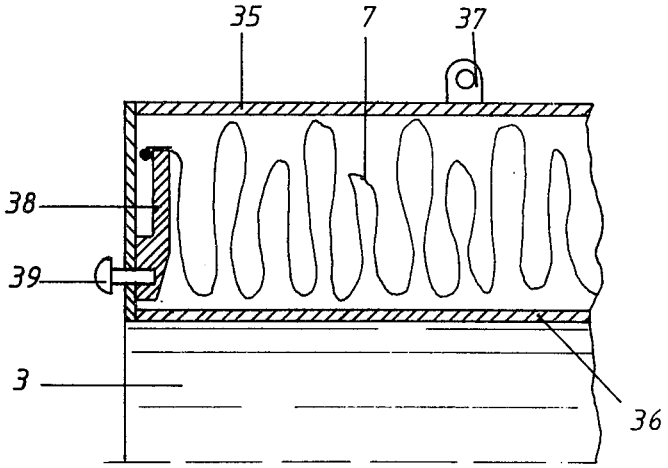
FIG. 12 is a cross-sectional view of a further embodiment of a ventilating pipe store.

In FIG. 12 it can also be seen that on the upper side of the outer periphery of the outer cylinder there is secured an eye 37 above the centre of gravity of the ventilating pipe store 3, or a carrier track 37' as seen in FIGS. 1–3, which facilitates the transport of the ventilating pipe store.

Suitable material for the ventilating pipe 7 is a foldable plastics foil on a fabric base which on the one hand folds relatively well or is stuffable into the store but on the other hand has an adequate resistance to damage and unintentional deformation. As is common with such ventilating pipes, it is also provided that, when using the apparatus in accordance with the invention, the ventilating pipe is suspended at the common spacing of today at about 0.5 m. Furthermore the nozzle of the apparatus is provided, in a conventional manner, if necessary with an auxiliary ventilating pipe, which can be mounted, for instance, in the cylindrical region of the nozzle, in the direct vicinity of the ventilating pipe. The nozzle also carries at its front outlet end a, so-called, cylindrical measuring passage which permits a pressure and/or velocity measurement in a parallel current to constantly monitor the ventilation.

When the ventilating pipe is stuffed into the annular storage space relatively irregularly or in a more or less random form, there results advantageously a smaller external diameter of the ventilating pipe while maintaining the internal diameter constant. As a result the ventilating pipe store 3 has overall small dimensions which results in a low weight. Achieving as small a weight as possible is, for reasons of ease of handling, of particular importance underground or generally at the mine face. With a stuffing length of 1,100 to 1,300 mm. of the store, an extended length of the ventilating pipe 7 of 100 m is achieved with the ventilating pipe materials of today, whereby the smallest free internal diameter is about 700 to 1,200 mm. These dimensions lead to a total length of the apparatus of about 3,500 to 4,400 mm. The invention is in no way limited to these dimensional measurements. The embodiment illustrated relates to a construction in which the frame 1 with all its devices is situated below the end of the ventilating pipe. It has already been indicated with reference to FIG. 8 that a frame can also be realized without difficulty in the overhead position and can in many cases bring advantages, if, for example, the floor region of a narrow gallery is supposed only to be covered with devices in cases of extreme emergency. A lateral arrangement of the frame can also be advantageous in some special cases; in each application it depends merely on whether the individual parts of the apparatus in the form of the frame 1 have a secure reference plane on which they can be held and aligned.

A particularly advantageous alternative method of connection for the rods 12 and 14 which forms part of the invention is illustrated in the example of the rod 12 in FIGS. 13 to 16. In contrast to the embodiment shown in FIGS. 1–7, the rods do not have any eyes at their ends for the insertion of bolts or the like, but instead each of the two rods 12 and 14 is provided at its left hand, that is to say at the nozzle side, end with a bolt portion 50 standing out radially from the rod end, which in the operational state of the apparatus, when the funnel 4 together with the ventilating pipe store 3 is clamped to the nozzle 2, is situated in a locking position of a bolt receiving portion 51 which is secured to the piston rod 10' of the cylinder 10. Components, which are not illustrated, below the nozzle 2 correspond to the components 10, 10' and 51, namely as the cylinders 10, 9 lie opposite one another as drive means for the rods 12 and 14 respectively secured to the portal frame 1*a* in FIGS. 1–7. Due to the identical construction the description is limited to the connection of the rod 12. As may be seen, particularly from the plan view of FIG. 14, the bolt receiving portion 51 has a laterally open recess 52 with a projecting portion 53 in which the bolt portion 50 takes up its locking position, as shown in side view in FIG. 13 and as a plan view in FIG. 14. When inserting or exchanging the ventilating pipe store 3, the bolt receiving section 57 is moved out in a radial plane in which the bolt portion 50, by rotating the rod 12, swings out of the recess 52 and thus out of the locking position thus becoming unlocked, without the freeing and removal of a bolt or the like being necessary for this purpose.

Figure 13:
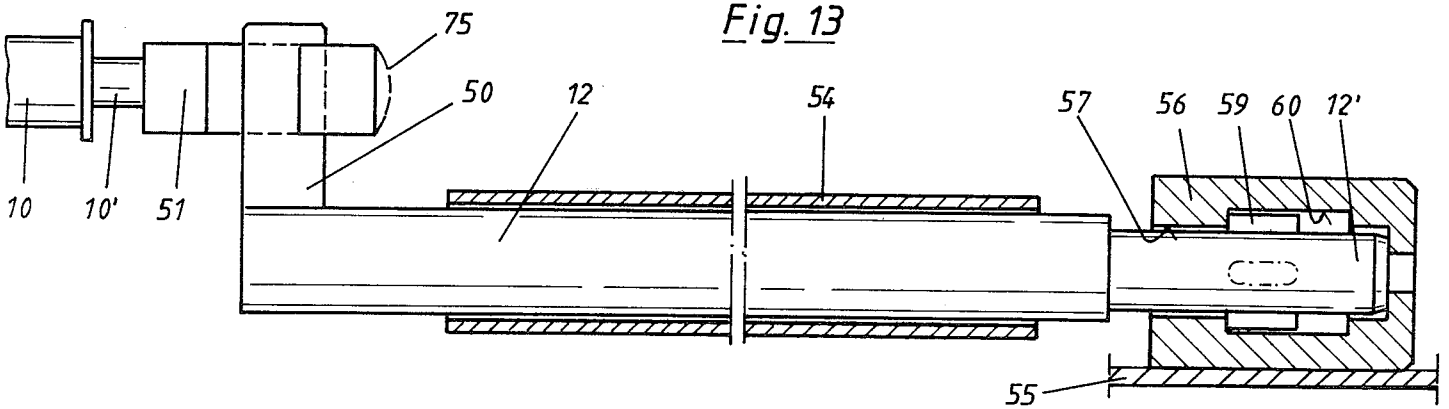
FIGS. 13–16 are different views of an alternative embodiment of a releasable connection of the rods used as a retaining and tensioning means for the store.
Figure 16:
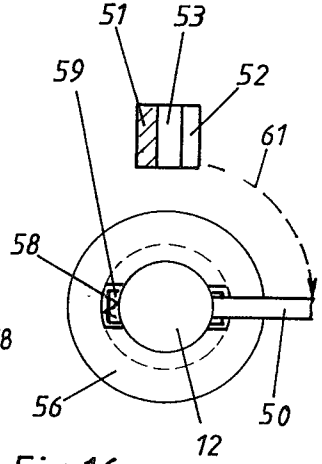
Figure 15:
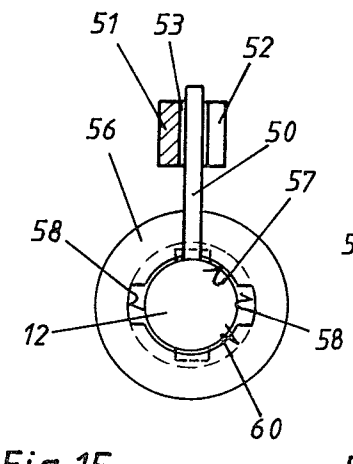
Figure 14:
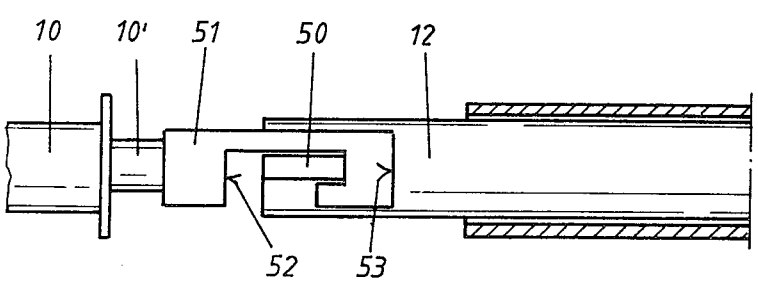

A similar locking principle is used at the funnel end as shown in the right hand portion of FIG. 13 in conjunction with FIGS. 15 and 16. Numeral 54 merely designates the receiving tube axially traversing the ventilating pipe store 3 for the rod 12, so that the tube 54 is situated approximately in the position of the rods 12 or 14, as shown in FIGS. 1–7.

Axially opposed to the bolt receiving portion 51 for the rod 12 and the corresponding bolt receiving portion for the rod 14 (not shown) there is a sleeve nut 56 connected to the annular connecting piece 55, with which the funnel 4 is connected to the ventilating pipe store 3, the upper and lower nuts being angularly offset by 180° (right hand portion of FIG. 13, FIGS. 15 and 16). At the left hand end directed towards the ventilating pipe store 3 the sleeve nut 56 has a bore 57, suitable for the insertion of the rod end 12' and appropriately dimensioned, which has two opposed slots 58 which extend axially and communicate with a bolt receptor 60. The rod end 12' has radially opposed flat locking members 59 which, when appropriately orientated (FIG. 16) pass through the slots 58 into the bolt receptor 60 where they take up the locking position, as shown in the right hand portion of FIG. 13 and in FIG. 15, as soon as the rod 12 is turned through 90°. To release the lock the rod 12 is swung back through 90°, as described above, (see the broken arrow 61 in FIG. 16) so that the rod 12 leaves its locking position both on its left and right hand side and may be pulled out to the left from the ventilating pipe store 3 or the receiving tube 54.

After inserting a full ventilating pipe store 3 there is an appropriate rotation of 90° due to a corresponding rotation of the rod 12 (and the rod 14) so that the bolt portion 50 comes into the recess 52 and the locking members 59 in the sleeve nut 56 take up their locking position in the bolt receptor 60. Then the ventilating pipe store 3 is clamped between the funnel 4 and the nozzle 2 by actuating the cylinders 9 and 10, and for this the portal-like frame 1*a* to which the cylinders 9 and 10 are secured acts as a reactive support.

Figure 18:
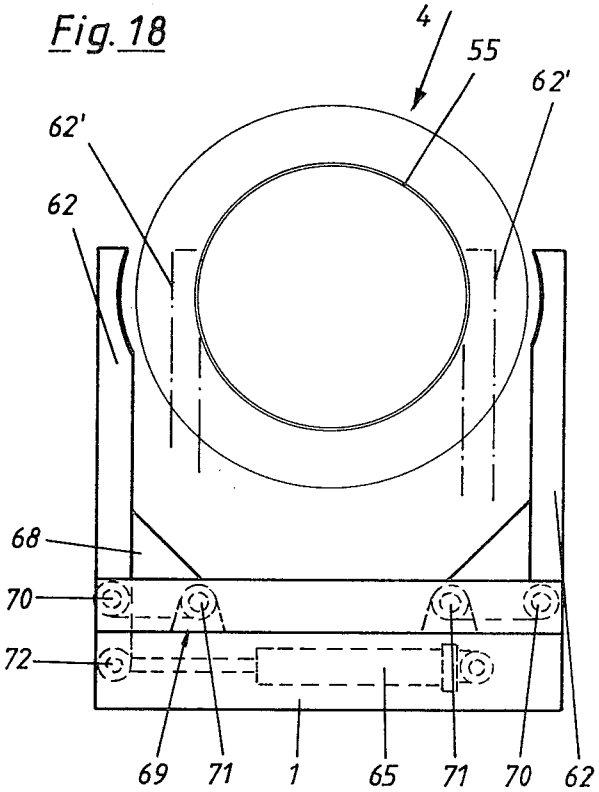
FIGS. 17 and 18 are two views of an alternative embodiment of a mounting for the funnel.
Figure 17:
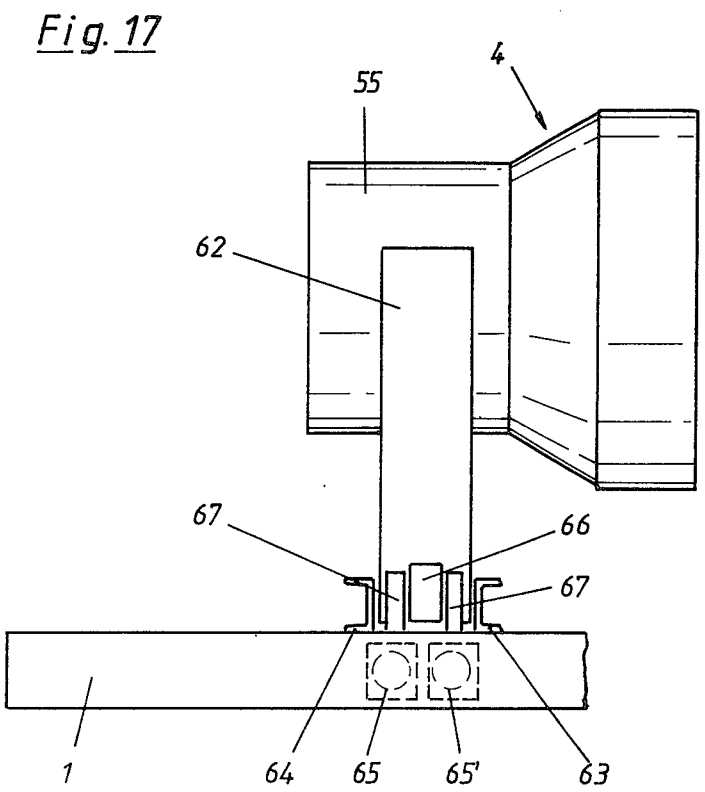

Also a part of the invention is the mounting for the funnel 4, seen in FIGS. 17 and 18 in side and front view respectively, which may be used as an alternative in place of the pivot arm 16 actuated by the piston/cylinder unit 17 and is particularly advantageous by comparison with this construction. Most importantly, it does not require connection by means of bolts or the like as in the case of the pivot arm 16 which may be seen in e.g. FIG. 5 and which as shown in FIG. 5 is connected to the lower eye 15 while the ventilating pipe store 3 is exchanged and during this process the funnel 4 must be supported.

In this mounting there is a pair of spaced vertically extending claws 62 provided, arranged in the manner shown in the drawings, the inner surface of the upper ends of which is provided with a rounded portion directed towards the connecting tube 55 of the funnel 4, each of which claws is slidable in the opposite sense within guide profiles 63, 64 by means of adjacently disposed piston/cylinder units 65, 65'. Each of the claws 62 is releasably hingeably connected by means of a web 66 to connecting components 67 which are pivoted at the ends of the piston rods. By means of reinforcing components 68, the claws 62 are each supported or so mounted on a sliding carriage 69 (only shown schematically) that the claws 62 can bring the necessary supporting forces to bear at their upper ends where their inner surfaces are rounded when the claws 62 take up their inner position, designated 62', to support and as a mounting for the funnel 4 which in this manner is restrained from tilting. Furthermore the claws 62, 62' engage the connecting piece 55 of the funnel 4 between a radially upstanding connection ring (not shown in FIG. 7) situated at the left hand end of the nozzle 2 and the obliquely outwardly pointing extension of the funnel 4 so that the funnel 4 is also secured in the axial direction by the claws 62, 62'.

For carrying out maintentance work the connections at the points 70 and 71 are releasable so that the claws 62 are pivotable outwardly away or swingable down about the respective pivotal axis 72 (only shown on the left hand side of FIG. 18).

In another embodiment in accordance with the invention which is not shown, two pairs of rollers are arranged spaced apart on the sliding carriage 8 to receive the ventilating pipe store 3 so that the ventilating pipe store 3 can not only slide back and forth together with the sliding carriage 8 on the slide track 1' comprising ball bearings 18 but also execute a rotary movement about its central longitudinal axis.

What we claim as our invention and desire to secure by Letters Patent is:

1. Apparatus for guiding and extending ventilating conduits, said apparatus comprising: a replaceable ventilating pipe store having an upstream end and a downstream end and being exchangeable when empty with a full ventilating pipe store, a funnel guide releasably connected to said upstream end of said ventilating pipe store, an outlet nozzle releasably connected to said downstream end of said ventilating pipe store, a flexible ventilating pipe withdrawably accommodated in a folded condition on said ventilating pipe store and having an upstream end connectable to a ventilating conduit, and a main frame carrying said ventilating pipe store and said funnel guide to enable said flexible ventilating pipe to be progressively withdrawn from said ventilating pipe store and extended along an axial line of said apparatus and guided over said funnel guide during advancement of said apparatus and to enable said store to be exchanged when empty for a full store, said main frame having means for carrying said ventilating pipe store except during those periods when said ventilating pipe store is being exchanged and having means for carrying said funnel guide only during said periods.

2. Apparatus as claimed in claim 1 wherein said main frame is disposed below said ventilating pipe store, said nozzle and said funnel guide, said apparatus further including transfer means for moving said ventilating pipe store transversely with respect to said axial line.

3. Apparatus as claimed in claim 1 or claim 2 including means for permitting at least limited relative motion of said nozzle and said ventilating pipe store in the direction of said axial line.

4. Apparatus as claimed in claim 1 or claim 2 including means for permitting at least limited relative motion of said funnel guide and said ventilating pipe store in the direction of said axial line.

5. Apparatus as claimed in claim 1 including means for permitting movement of said funnel guide and said nozzle away from said ventilating pipe store in opposite directions along said axial line.

6. Apparatus as claimed in claim 2 wherein said transfer means comprises a slideable carriage, said apparatus further including drive means to move said carriage, bearing means on which said carriage can move, and projection means carried by said carriage for receiving and retaining said ventilating pipe store.

7. Apparatus as claimed in claim 3 wherein said means which permit relative motion of said nozzle and said ventilating pipe store comprises a track along which said nozzle can move and actuable drive means secured to said frame for moving said nozzle along said track.

8. Apparatus as claimed in any one of claims 1, 2 and 5 including connecting elements urging said nozzle and said funnel guide together against said ventilating pipe store.

9. Apparatus as claimed in claim 8 wherein said connecting elements comprise two rods, said apparatus further including two actuable tensioning means for releasably securing said connecting elements and a portal-like frame connected to said main frame, said two tensioning means being carried by said portal-like frame and wherein said rods extend through said ventilating pipe store and are releasably secured to said funnel guide.

10. Apparatus as claimed in claim 9 wherein said two rods are arranged in a parallel relationship, one of said two rods being arranged vertically above the other of said rods.

11. Apparatus as claimed in claim 4 wherein said means which permit relative motion of said funnel guide and said ventilating pipe includes a pivotally mounted arm and actuable drive means connected to said main frame for pivoting said pivotally mounted arm between a rest position in which, in use, it is spaced from said ventilating pipe and an actuated position in which it may be connected to said funnel guide and thereby secure said funnel guide to said main frame.

12. Apparatus as claimed in claim 1 or claim 2 including support means for supporting said funnel guide and drive means for moving said support means both vertically and laterally.

13. Apparatus as claimed in any one of claims 7, 9 or 11 wherein each of said actuable means comprises a fluid operated piston/cylinder unit.

14. Apparatus as claimed in claim 1 or claim 2 wherein said ventilating pipe store comprises two nested cylinders, said two cylinders together defining an annular space, said annular space being closed in the direction of said nozzle, open in the direction of said funnel guide and accommodating said ventilating pipe.

15. Apparatus as claimed in claim 14 wherein said ventilating pipe is accommodated in said annular space in a randomly folded configuration.

16. Apparatus as claimed in claim 1 or claim 2 including suspension means provided on said ventilating pipe and said ventilating pipe store from which they may be suspended.

17. Apparatus as claimed in claim 1 or claim 2 including sealing means and centering means at the junctions of said ventilating pipe store with said nozzle and said funnel guide.

18. Apparatus as claimed in claim 1 or claim 2 including a sealing lip extending around said funnel guide effective to seal said funnel guide to said ventilating pipe, said sealing lip extending away from said funnel and away from said nozzle in its unloaded state.

19. Apparatus as claimed in claim 1 or claim 2 wherein said ventilating pipe has two ends, each said end having a bead, whereby one end of said ventilating pipe may be connected to one end of an adjacent ventilating pipe by inserting the one end into the other end and placing a wire rope around said two ventilating pipes between said two beads.

20. Apparatus as claimed in claim 1 or claim 2 including a flexible annular tube having an externally convex cross-section extending around said funnel to serve, in use, as a seal between said funnel and said ventilating pipe.

21. Apparatus as claimed in claim 9 wherein said two rods and at least one of said funnel guide and said portal-like frame comprise locking means.

22. Apparatus as claimed in claim 21 wherein said locking means are constructed to be engaged or disengaged by rotation of said rods.

23. Apparatus as claimed in claim 1 or claim 2 including two claws operable to support said funnel guide during those periods when said ventilating pipe store is being exchanged.

24. Apparatus as claimed in claim 1 or claim 2 including rotary means for permitting said ventilating pipe store to rotate about an axis parallel to said axial line, at least during those periods when said ventilating pipe store is being exchanged.

25. Apparatus for use with ventilating conduit installed in an underground tunnel for extending the length of the ventilating conduit comprising: a set of full conduit stores each comprised of a tubular core having upstream and downstream ends, and a length of foldable conduit removably stored on the outer periphery of the core in an axially folded condition and axially unfoldable to form a length of unfolded ventilating conduit; and a movable assembly movable in an axial direction away from an installed ventilating conduit for exchangeably positioning full stores in working positions for end-to-end attachment of the respective lengths of foldable conduit stored thereon to thereby extend the overall length of the installed ventilating conduit, the assembly comprising a movable main frame having means thereon for replaceably supporting individual ones of the full stores in a working position in which the folded conduit can be unfolded and in which an empty store can be replaced by a full store, means for attaching one end of the folded conduit of the store supported on the main frame to the free trailing end of the installed ventilating conduit, and guide means mounted on said main frame for progressively engaging with and guiding the interior surface of the folded conduit of the store supported on the main frame to effect progressive removal of the folded conduit from the core and progressive unfolding thereof into a length of unfolded conduit in response to axial movement of the main frame away from the free trailing end of the installed ventilating conduit whereby empty stores can be replaced with full stores whose folded conduits are successively unfolded and attached in end-to-end relation thereby extending the overall length of the ventilating conduit.

26. Apparatus according to claim 25; wherein the movable assembly further comprises an outlet nozzle mounted on said main frame and releasably connectable to the upstream end of the core of the store supported on the main frame.

27. Apparatus according to claim 26; wherein the means for replaceably supporting individual ones of the stores on the main frame comprises means including a plurality of connecting elements extending through the store for urging the outlet nozzle and guide means together against the store thereby supporting the store in the working position on the main frame.

28. Apparatus according to claim 27; wherein each store includes guides extending axially therethrough for releasably receiving respective ones of the connecting elements.

29. Apparatus according to claim 27; further comprising locking means including said connecting elements for releasably locking the store in the working position on the main frame.

* * * * *